US006745163B1

(12) United States Patent
Brocious et al.

(10) Patent No.: US 6,745,163 B1
(45) Date of Patent: Jun. 1, 2004

(54) METHOD AND SYSTEM FOR SYNCHRONIZING AUDIO AND VISUAL PRESENTATION IN A MULTI-MODAL CONTENT RENDERER

(75) Inventors: Larry A. Brocious, Apalachin, NY (US); Stephen V. Feustel, Endwell, NY (US); James P. Hennessy, Endicott, NY (US); Michael J. Howland, Endicott, NY (US); Steven M. Pritko, Endicott, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/670,800

(22) Filed: Sep. 27, 2000

(51) Int. Cl.[7] ..... G10L 13/00
(52) U.S. Cl. ..... 704/260; 707/513
(58) Field of Search ..... 704/260, 258, 704/270, 275, 271, 276, 272, 277, 278; 707/513

(56) References Cited

U.S. PATENT DOCUMENTS

| | | | | | |
|---|---|---|---|---|---|
| 5,634,084 | A | * | 5/1997 | Malsheen et al. | 704/260 |
| 5,748,186 | A | | 5/1998 | Raman | |
| 5,850,629 | A | * | 12/1998 | Holm et al. | 704/260 |
| 5,884,266 | A | | 3/1999 | Dvorak | |
| 5,890,123 | A | | 3/1999 | Brown et al. | |
| 6,064,961 | A | * | 5/2000 | Hanson | 704/260 |
| 6,085,161 | A | * | 7/2000 | MacKenty et al. | 704/270 |
| 6,088,675 | A | * | 7/2000 | MacKenty et al. | 704/270 |
| 6,115,686 | A | * | 9/2000 | Chung et al. | 704/260 |
| 6,208,334 | B1 | * | 3/2001 | Ueda | 345/302 |
| 6,324,511 | B1 | * | 11/2001 | Kiraly et al. | 704/260 |

FOREIGN PATENT DOCUMENTS

| | | |
|---|---|---|
| GB | 2317 070 A | 3/1998 |
| JP | 07 175909 | 7/1995 |
| WO | WO 00/21027 | 4/2000 |
| WO | WO 00/21057 | 4/2000 |

OTHER PUBLICATIONS

PCT International Preliminary Examination Report dated Sep. 12, 2000.
PCT Written Opinion dated Jun. 14, 2002.
International Search Report.
Yamada, "Visual Text Reader for Virtual Image Communication on Networks" IEEE Workshop on Multimedia Signal Processing. Proceedings of Singal Processing Society Workshop on Multimedia Signal Processing, Jun. 23, 1997 (pp. 495–500).
International Search Report Issued by United Kingdom.

* cited by examiner

*Primary Examiner*—Daniel Abebe
(74) *Attorney, Agent, or Firm*—Arthur J. Samodovitz

(57) ABSTRACT

A system and method for a multi-modal browser/renderer that simultaneously renders content visually and verbally in a synchronized manner are provided without having the server applications change. The system and method receives a document via a computer network, parses the text in the document, provides an audible component associated with the text, simultaneously transmits to output the text and the audible component. The desired behavior for the renderer is that when some section of that content is being heard by the user, that section is visible on the screen and, furthermore, the specific visual content being audibly rendered is somehow highlighted visually. In addition, the invention also reacts to input from either the visual component or the aural component. The invention also allows any application or server to be accessible to someone via audio instead of visual means by having the browser handle the Embedded Browser Markup Language (EBML) disclosed herein so that it is audibly read to the user. Existing EBML statements can also be combined so that what is audibly read to the user is related to, but not identical to, the EBML text. The present invention also solves the problem of synchronizing audio and visual presentation of existing content via markup language changes rather than by application code changes.

22 Claims, 8 Drawing Sheets

METHOD AND SYSTEM FOR SYNCHRONIZING AUDIO AND VISUAL PRESENTATION IN A MULTI-MODAL CONTENT RENDERER

BACKGROUND OF THE INVENTION

1. Field of the Invention

The present invention generally relates to a multi-modal audio-visual content renderer and, more particularly, to a multi-modal content renderer that simultaneously renders content visually and verbally in a synchronized manner.

2. Background Description

In the current art, content renderers (e.g., Web browsers) do not directly synchronize audio and visual presentation of related material and, in most cases, they are exclusive of each other. The presentation of HyperText Markup Language (HTML) encoded content on a standard browser (e.g., Netscape or Internet Explorer) is primarily visual. The rate and method of progression through the presentation is under user control. The user may read the entire content from beginning to end, scrolling as necessary if the rendered content is scrollable (that is, the visual content extends beyond the bounds of the presentation window). The user may also sample or scan the content and read, for example, only the beginning and end. Fundamentally, all of the strategies available for perusing a book, newspaper, or other printed item are available to the user of a standard browser.

Presentation of audio content tends to be much more linear. Normal conversational spoken content progresses from a beginning, through a middle, and to an end; the user has no direct control over this progression. This can be overcome to some degree on recorded media via indexing and fast searching, but the same ease of random access available with printed material is difficult to achieve. Voice controlled browsers are typically concerned with voice control of browser input or various methods of audibly distinguishing an HTML link during audible output. Known prior art browsers are not concerned with general synchronization issues between the audio and visual components.

There are several situations where a person may be interested in simultaneously receiving synchronized audio and visual presentations of particular subject matter. For example, in an automotive setting a driver and/or a passenger might be interfacing with a device. While driving, the driver obviously cannot visually read a screen or monitor on which the information is displayed. The driver could, however, select options pertaining to which information he or she wants the browser to present audibly. The passenger, however, may want to follow along by reading the screen while the audio portion is read aloud.

Also, consider the situation of an illiterate or semi-literate adult. He or she can follow along when the browser is reading the text, and use it to learn how to read and recognize new words. Such a browser may also assist the adult in learning to read by providing adult content, rather than content aimed at a child learning to read. Finally, a visually impaired person who wants to interact with the browser can "see" and find highlighted text, although he or she may not be able to read it.

There are several challenges in the simultaneous presentation of content between the audio and video modes. The chief one is synchronizing the two presentations. For example, a long piece of content may be visually rendered on multiple pages. The present invention provides a method and system such that when some section of that content is being heard by the user, that section is visible on the screen and, furthermore, the specific visual content (e.g., the word or phrase) being audibly rendered is somehow highlighted visually. This implies automatic scrolling as the audio presentation progresses, as well as word-to-word highlighting.

A further complication is that the visual presentation and audible presentation may not map one-to-one. Some applications may want some portions of the content to be rendered only visually, without being spoken. Some applications may require content to be spoken, with no visual rendering. Other cases lie somewhere in between. For example, an application may want a person's full name to be read while a nickname is displayed visually.

U.S. Pat. No. 5,884,266 issued to Dvorak, entitled "Audio Interface for Document Based on Information Resource Navigation and Method Therefor", embodies the idea that markup links are presented to the user using audibly. distinct sounds, or speech characteristics such as a different voice, to enable the user to distinguish the links from the non-link markup.

U.S. Pat. No. 5,890,123 issued to Brown et al., entitled "System and Method for Voice Controlled Video Screen Display", concerns verbal commands for the manipulation of the browser once content is rendered. This patent primarily focuses on digesting the content as it is displayed, and using this to augment the possible verbal interaction.

U.S. Pat. No. 5,748,186 issued to Raman, entitled "Multimodal Information Presentation System", concerns obtaining information, modeling it in a common intermediate representation, and providing multiple ways, or views, into the data. However, the Raman patent does not disclose how the synchronization is done.

SUMMARY OF THE INVENTION

It is therefore an object of the present invention to provide a multi-modal renderer that simultaneously renders content visually and verbally in a synchronized manner.

Another object of the invention is to provide a multi-modal renderer that allows content encoded using an eXtensible Markup Language (XML) based markup tag set to be audibly read to the user.

The present invention provides a system and method for simultaneously rendering content visually and verbally in a synchronized manner. The invention renders a document both visually and audibly to a user. The desired behavior for the content renderer is that when some section of that content is being heard by the user, that section is visible on the screen and, furthermore, the specific visual content (e.g., the word or phrase) being audibly rendered is highlighted visually. In addition, the invention also reacts to multi-modal input (either tactile input or voice input). The invention also allows an application or server to be accessible to someone via audio instead of visual means by having the renderer handle Embedded Browser Markup Language (EBML) code so that it is audibly read to the user. EBML statements can also be combined so that what is audibly read to the user is related to, but not identical to, the visual text. The present invention also solves the problem of synchronizing audio and visual presentation of changing content via markup language changes rather than by application code changes.

The EBML contains a subset of Hypertext Markup Language (HTML), which is a well-known collection of markup tags used primarily in association with the World Wide Web (WWW) portion of the Internet. EBML also integrates several tags from a different tag set, Java Speech Markup Language (JSML). JSML contains tags to control audio rendering. The markup language of the present invention provides tags for synchronizing and coordinating the visual and verbal components of a web page. For example, text appearing between <SILENT> and </SILENT> tags will appear on the screen but not be audibly rendered. Text appearing between <INVISIBLE> and </INVISIBLE> tags will be spoken but not seen. A <SAYAS> tag, adapted from JSML, allows text (or recorded audio such as WAV files, the native digital audio format used in Microsoft Windows® operating system) that differs from the visually rendered content to be spoken (or played).

The method for synchronizing an audio and visual presentation in the multi-modal browser includes the steps of receiving a document via a computer network, parsing the text in the document, providing an audible component associated with the text, and simultaneously transmitting to output the text and the audible components.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
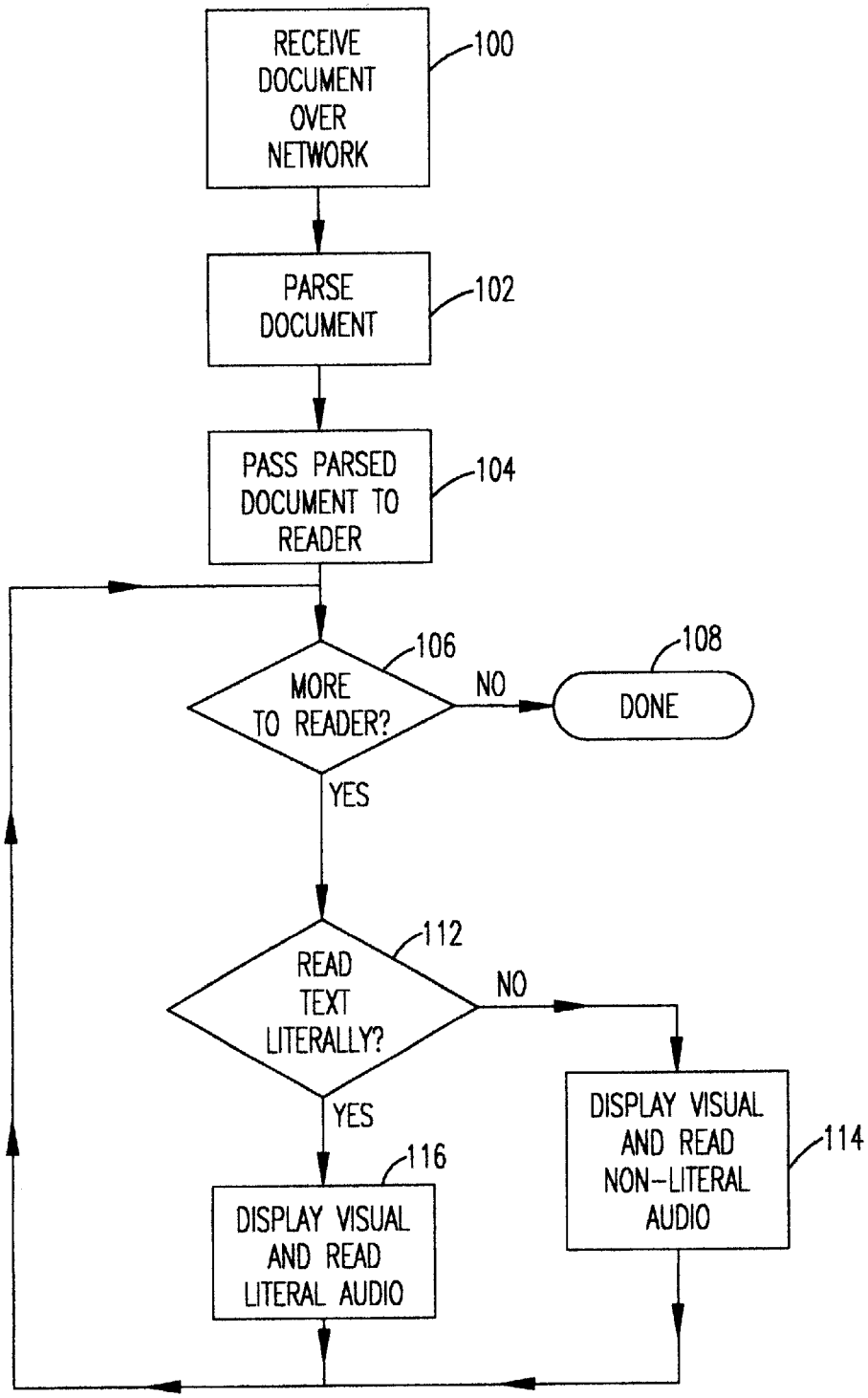
FIG. 1 is a logical flow diagram illustrating the method of the present invention.

Referring now to the drawings, and more particularly to FIG. 1, there is shown a logical flow diagram illustrating the method of the present invention. A document is input, or received over a computer network, in function block 100. In function block 102, the document is parsed to separate the text from the EBML tags. In function block 104, the parsed document is passed to the EBML renderer. A test is then made in decision block 106 to determine if there is more of the document to render. If not, the process terminates at 108; otherwise, a test is made in decision block 112 to determine whether to read the text of the subdocument literally. If not, the visual component is displayed, and an audio portion is read that does not literally correspond to the visual component in function block 114. If the determination in decision block 112 is that the text is to be read literally, the visual component is displayed, and an audio portion is read that literally corresponds to the visual component in function block 116. After either of the operations of function blocks 114 and 116 are performed, the process loops back to decision block 106 until a determination is made that there is no more rendering to be done.

Figure 2:
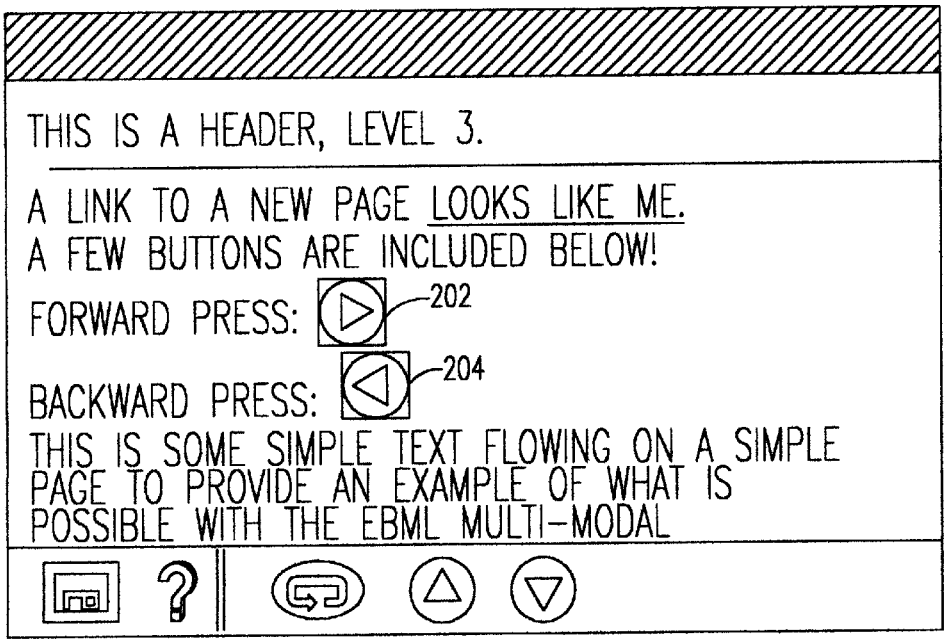
FIG. 2 is an example of a rendered page with a touchable component.

FIG. 2 is an example of a rendered page with a touchable component. A user can visually read the text on this page as it is being read aloud. As each word is being audibly read to the user, it is also highlighted, which makes it quicker and easier to identify and touch what has just been read (or near to what was just read). Additionally, buttons 202 and 204 are displayed that makes it easy for the reader to advance to the next screen or return to a previous screen, respectively. By generating its EBML correctly, the application can read all articles in order, but skip the current article if, for example, button 202 on the screen is pushed. A driver of an automobile, for example, can thus visually focus on the road, hear the topic/title of an article and quickly find the advance button 202 on the touch screen if the article is not of interest. In a preferred embodiment, the browser audibly prompts the user to advance to the next screen by saying, for example, "to skip this article press the advance to next screen button". Additionally, the button can be made to stand out from the rest of the screen, such as by flashing and/or by using a color that makes the button readily apparent. The ease with which a user can press button 202 to skip the current article or button 204 to return to a previous article is comparable to the ease of turning on the radio or selecting another radio channel.

Figure 3:
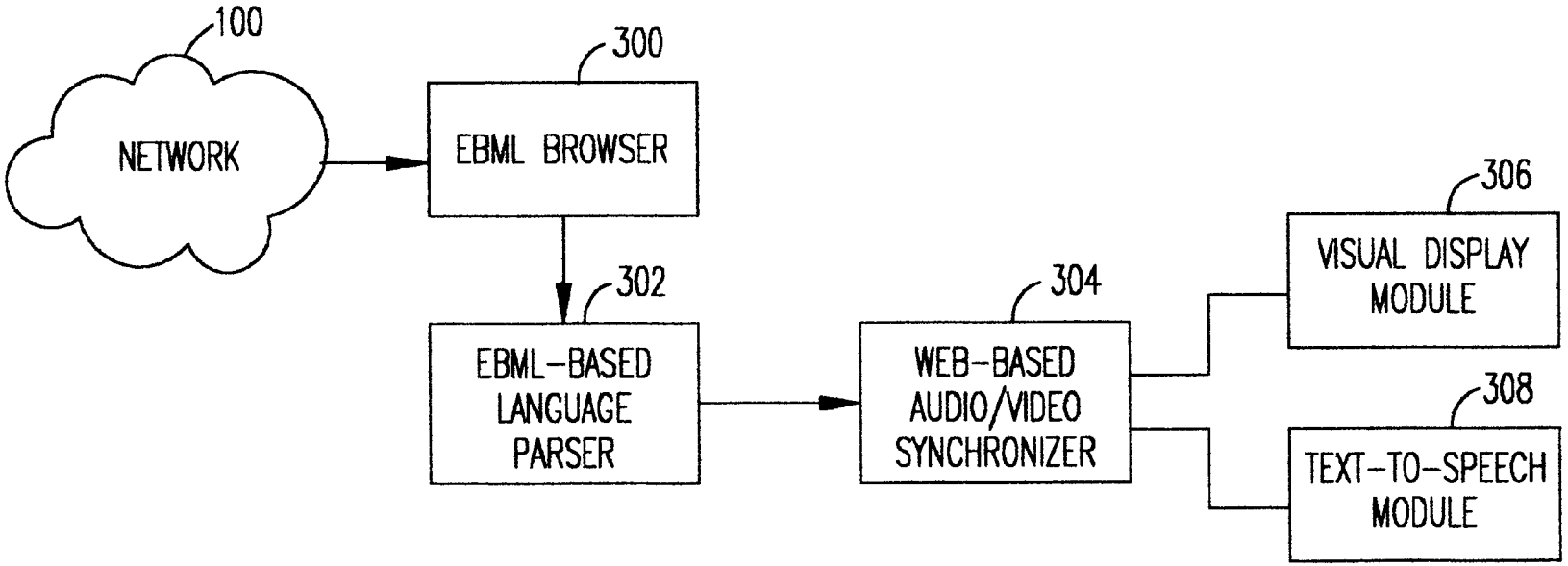
FIG. 3 is a block diagram of a system on which the present invention may be implemented.

FIG. 3 is a block diagram of the system on which the present invention may be implemented. The EBML browser 300 receives EBML-embedded content from a network 100. The browser 300 passes the content to an EBML language parser 302, which parses the EBML language of the received content. The parser 302 then provides the content to be rendered to the audio-video synchronizer 304, which synchronizes the output of each of the audio and video portions of the original EBML. The display module 306 and the text to speech (TTS) module 308 both receive output from the audio-video synchronizer 304. TTS module 308 prepares the audio portion of the EBML page that is to be read, and display module 306 displays the visual portion so that it is synchronized with the audio portion from TTS module 308.

In a preferred embodiment of the present invention, there are three stages between parsing of the EBML and completion of rendering which enable and execute the synchronized aural and visual rendering of the content: a) building of the model; b) construction of the views of the model; and c) rendering.

Turning now to building the model stage of the present invention that synchronizes the audio and visual components, when the markup language is parsed by parser 302, a model tree is built that contains model elements for each tag in the markup language. Elements for nested tags appear beneath their parent elements in the model tree. For example, the following code

Figure 4A:
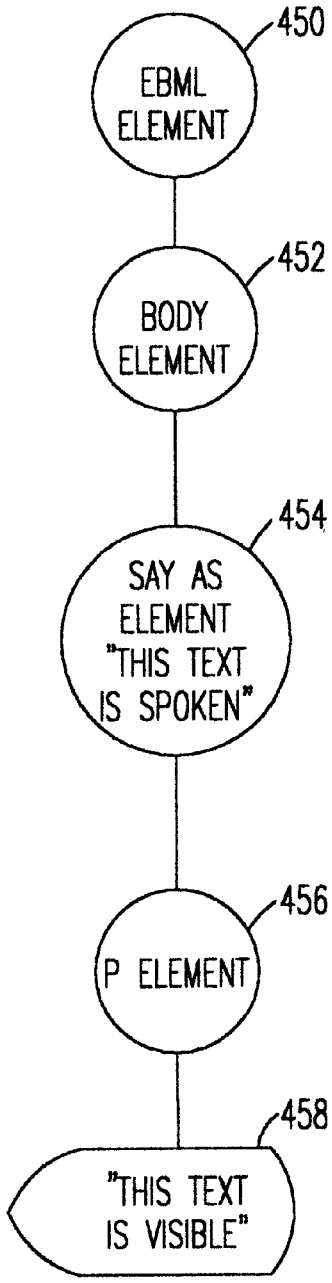
FIG. 4A is a diagram of an example of a model tree.

```
<EBML>                                          (1)
    <BODY>                                      (2)
        <SAYAS SUB="This text is spoken.">      (3)
            <P> This text is visible.</P>       (4)
        </SAYAS>                                (5)
    </BODY>                                     (6)
</EBML>                                         (7)
```

would result in the model tree shown in FIG. 4A. Specifically the Pelement 456 (for paragraph) appears below SayasElement 454. The SayasElement 454, in turn, appears below the BodyElement 452. Finally, the BodyElement 452 is a child of the EMBLElement 450. The text itself (e.g., "This text is visible") is contained in a special text element 458 at the bottom of the tree.

Figure 4B:
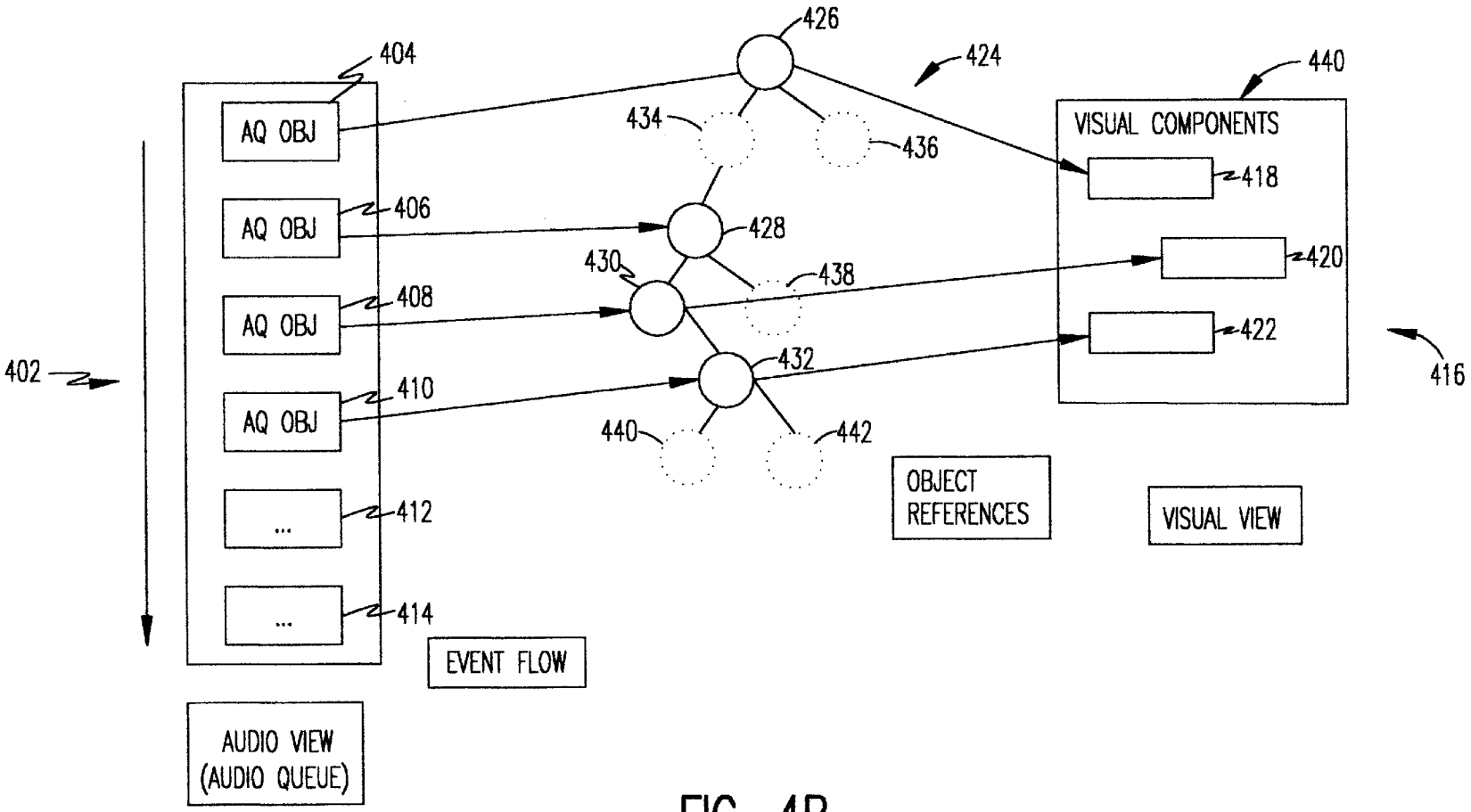
FIG. 4B is a diagram showing a general representation of the relationship between a model tree and audio and visual views.

Turning now to the constructing the views stage of the invention, as shown in FIG. 4B, once the model tree 424 is built in accordance with the source code provided, it is traversed to create separate audio 402 and visual 416 views of the model. The audio view 402 contains a queue of audio elements (404, 406, 408, 410, 412 and 414), which are objects representing either items to be spoken by, say, a text-to-speech voice engine 304 or by some media player, or items which enable control of the audio flow (e.g., branching in the audio queue, pausing, etc.). The visual view 416 contains a representation of the content usable by some windowing system 440 for visual rendering of components (418, 420, 422).

As each element (426, 434, 428, 430, 432, 440, 442, 438, 436) in the model tree 424 is traversed, it is instructed to build its visual 416 and audio 402 views. The visual or aural rendering of text within a given tag differs depending on where that tag appears in the model tree 424. In general, elements obtain their visual and aural attributes from their parent element in the model tree 424. Traversal of the model tree 424 guarantees that parent elements are processed before their children, and ensures, for example, that any elements nested inside a <SILENT> tag, no matter how deep, get a silent attribute. Traversal is a technique widely known to those skilled in the art and needs no further explanation.

The current element then modifies the attributes to reflect its own behavior thus effecting any nodes that fall below it in the tree. For example, a SilentElement sets the audible attribute to false. Any nodes falling below the <SILENT> node in the tree (that is, they were contained within the <SILENT> EBML construct) adopt an audio attribute that is consistent with those established by their ancestors. An element may also alter the views. For example, in a preferred embodiment, a SayasElement, like SilentElement, will set the audible attribute to false since something else is going to be spoken instead of any contained text. Additionally, however, it will introduce an object or objects on the audio view 402 to speak the substituted content contained in the tag attributes SUB= "This text is spoken.").

Finally, contained tags and text (i.e., child elements) are processed. A node is considered a parent to any nodes that fall below it in the tree 424. Thus, for example, nodes 434 and 436 of model tree 424 are child nodes of node 426, and node 426 is a parent node of nodes 434 and 436. In addition to a node being responsible for the generation of an Audio Output element (404, 406, 408, 410, 412 and 414 in FIG. 4B) they also have to generate a visual presence (418, 420 and 422 in FIG. 4B).

For contained tag elements (e.g., 434 and 436), they are simply asked to build their own views (i.e., the tree traversal continues). For contained text elements, the text is processed in accordance with all of the accumulated attributes. So, for example, if the attributes indicate audible but not visual content, the audio view 402 is modified but nothing is added to the visual view 416. In a preferred embodiment, most of the information on how to process the text is accumulated in the text attributes, so most elements do not need to handle processing their own contained text. Rather, they search up the model tree 424 for an element that has a method for processing the text. Only those elements that are later involved in keeping the visual and audible presentations synchronized have methods for processing the text (e.g., element 432). These elements, like SayAsElement, provide the link between the spoken content and the visual content. They register themselves to objects on the audio queue 402 so they receive notification when words or audio clips are spoken or played, and they maintain references to the corresponding visual view components. Therefore, it is only elements that have unique behavior relative to speaking and highlighting that need to have their own methods for processing the text. A SayAsElement, for example, must manage the fact that one block of text must be highlighted while a completely different audio content is being rendered, either by a TTS synthesizer or a pre-recorded audio clip. Most elements that have no such special behavior to manage and that do not appear in the tree under other elements with special behavior end up using the default text processing provided by the single root EBMLElement, which centralizes normal word-by-word highlighting.

Since only select elements are used within the model tree 424 to maintain the link between the audio and visual views, they need to persist beyond the phase of constructing the views and into the phase of rendering the content. One advantage of this method of constructing the views is that all other elements in the tree (typically the vast majority) are no longer needed during the rendering phase and can be deleted. Those expendable elements (434, 436, 438, 440, 442) are drawn in FIG. 4B with dashed lines. This benefit can result in dramatic storage savings. A typical page of markup can result in hundreds of tag and text nodes being built. After the audio and visual views have been built, a small handful of these nodes may remain to process speech events (and maintain synchronization between the views) during the view presentation.

During the rendering of the content, the renderer iterates through the audio view 402. The audio view 402 now consists of a series of objects that specify and control the audio progression including:

- objects containing text to be spoken;
- objects marking the entry/exit to elements;
- objects requesting an interruptible pause to the audio presentation; and
- objects requesting a repositioning of the audio view 402 (including the ability to loop back and repeat part of the audio queue).

As events are processed, the appropriate retained element (426, 428, 430, 432) in the model tree 424 is notified. The model tree 424, in turn, tells the corresponding visual components (428, 420, 422) the appropriate highlighting behavior and asks them to make themselves visible (i.e., asks them to tell their containing window to autoscroll as necessary).

To further understand the steps required to build/render a document, consider the following simple EBML document:

```
<EBML>
    <SAYAS SUB="Here comes a list!">
        <FONT SIZE="10" FACE="Sans">
            My list
        </FONT>
    </SAYAS>
    <UL>
        <LI>Apples</LI>
        <LI>Peaches</LI>
        <LI>Pumpkin Pie</LI>
    </UL>
</EBML>
```

Figure 5:
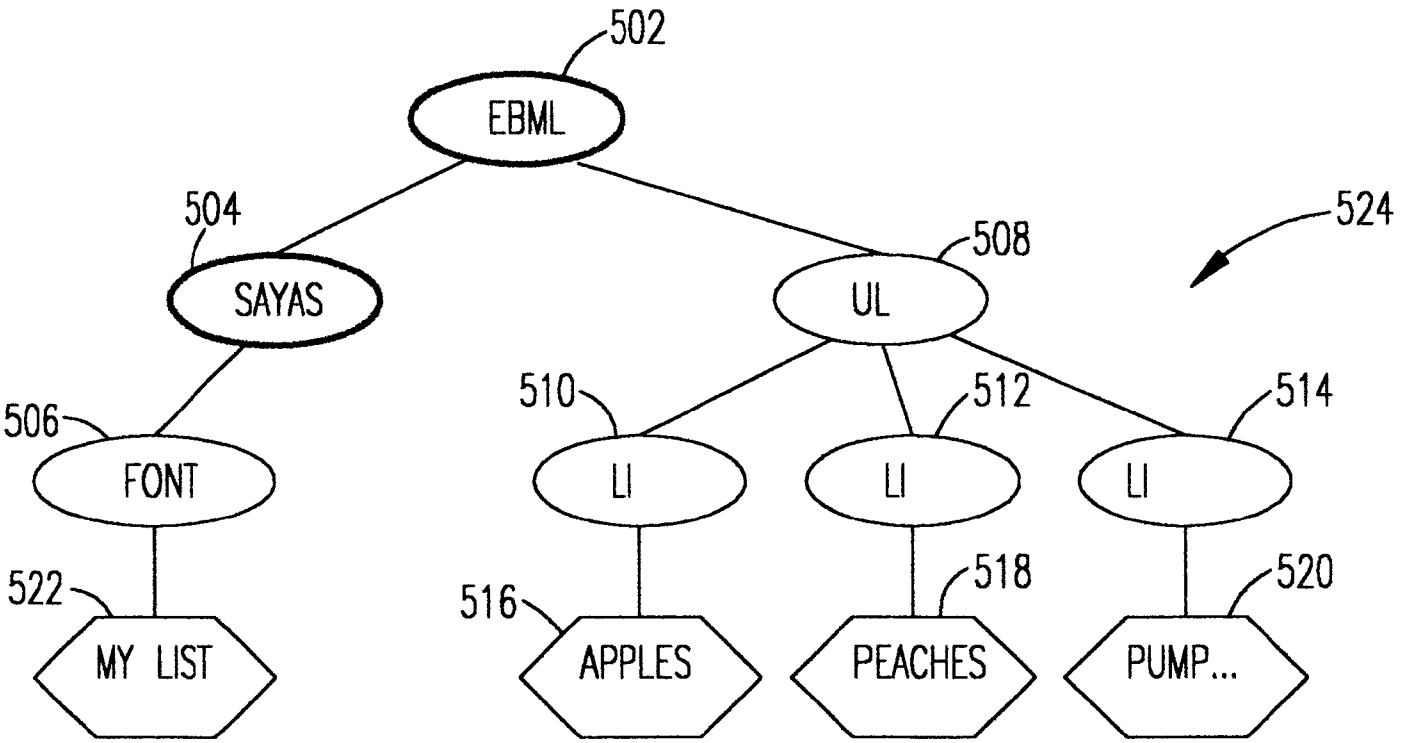
FIG. 5 shows an example of a parse tree generated during view building.

The parser 302 creates the model tree depicted in FIG. 5. The <EBML> 502 and <SAYAS> 504 nodes are indicated using a bold oval as these nodes are designed to handle text for those in their descendant tree (there are other tags in this category, but these are the two tags that happened to be in this example). It is these two nodes that do the actual addition of text to the audio/visual views. Non text nodes (506, 508, 510, 512, 514) are represented with the ovals containing the tag names. The browser uses this model tree 524 during the construction of the audio and visual views. Note that terminal nodes (516, 518, 520, 522) are indicated with a polygon. These nodes contain the actual text from the document. Nodes falling below in the tree just pass the build request up the tree without regard as to which node will handle the request.

After the parsing of the document is complete, the browser traverses the model tree 524 and begins the construction of the various required views. As the build routine in each node is reached it can do several things. First, the current text attribute object can be altered, which will affect the presentation of text by those below it in the tree. For example, if a <FONT> tag is reached, the <FONT> tag node alters the text attribute object to indicate that subsequent visual view build requests should use a particular font for any contained text. Those nodes below honor this attribute because each obtains its parents copy of the attribute object before beginning work. Second, the build routine can call up the model tree 524 to its ancestors and ask that a particular segment of text be handled. This is the default behavior for text nodes. Finally, the build routine can directly affect the view. For example, the <P> tag node can push a newline object onto the current visual view, thus causing the visual flow of text to be interrupted. Likewise, the <BREAK> tag can push an audio break object onto the audio queue, thus causing a brief pause in the audio output.

As nodes call up the ancestral tree asking for text to be handled, the nodes that implement this function (<EBML> and <SAYAS> in this example) are responsible for building the audio/visual views and coordinating any synchronization that is required during the presentation.

Figure 6:
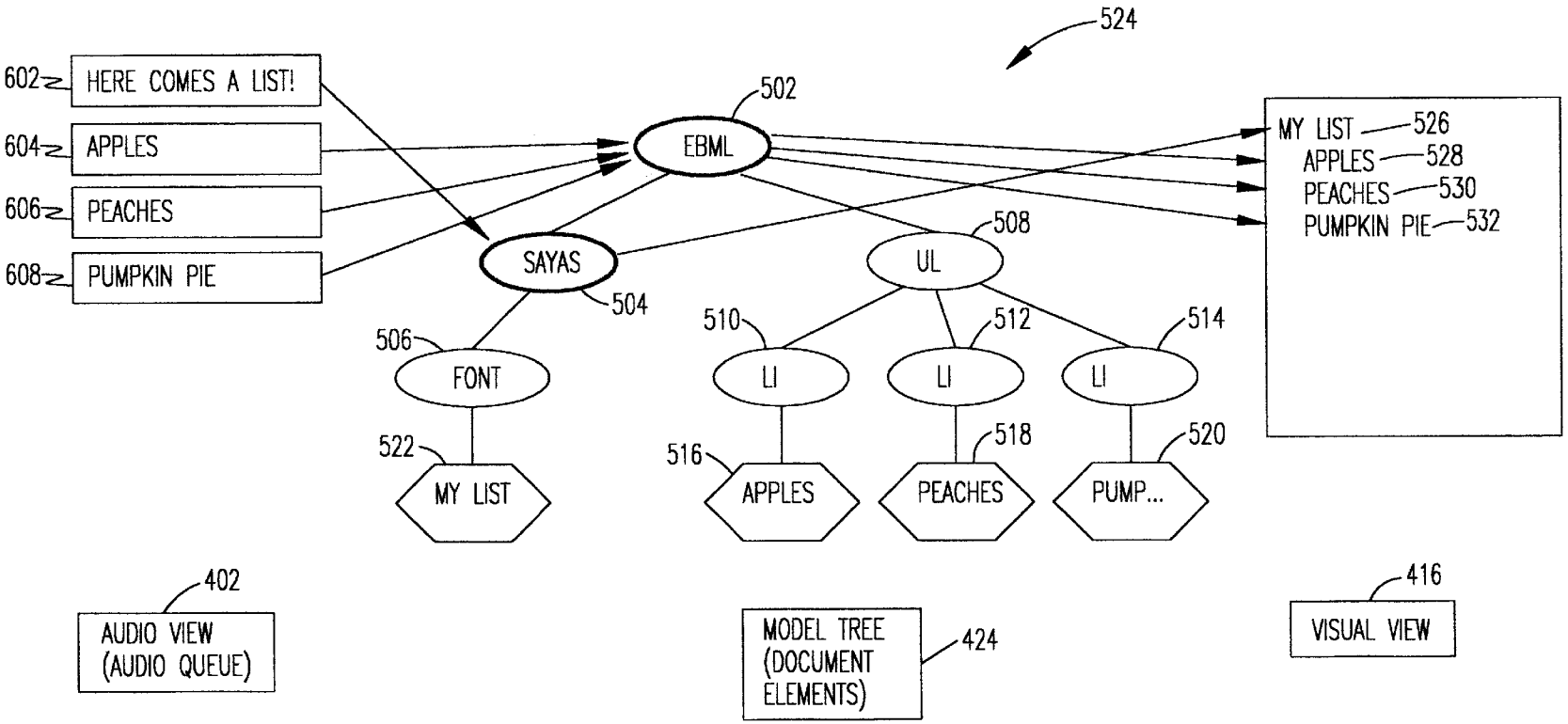
FIG. 6 shown an example of a view/model interrelationship.

FIG. 6 illustrates the relationships between the views and the model for the example EBML after the build has completed. As the audio queue 402 is built, references are maintained to the nodes responsible for the synchronization of the audio/visual views. For example, Audio view 402 item 602 points to the SAYAS tag 504, and audio queue item 604, 606 and 608 point to the EBML tag 502. This allows events issued by the speech engine 304 to be channeled to the correct node. The model, in turn, maintains references to the appropriate components in the visual presentation. This allows the model nodes to implement any synchronizing behavior required as the text is being presented aurally. In this example, the <SAYAS> node 504 takes care of synchronizing the different audio and visual presentation of items 602 and 526. The <EBML> 502 node provides the default behavior where the audio and visual presentations are the same, as shown by elements 604, 606, 608, and elements, 528, 530 and 532, respectively.

Once the views have been built, the model is instructed to dissolve any references held within the tree. For example, the Java Programming Language allows "garbage collection" in the Java Virtual Machine to collect nodes that are not needed to provide synchronization during the presentation. Other "garbage collection" systems can be used to automatically reclaim nodes. Those nodes that are required for synchronization are anchored by the audio view 402 and thus avoid being collected.

Figure 7:
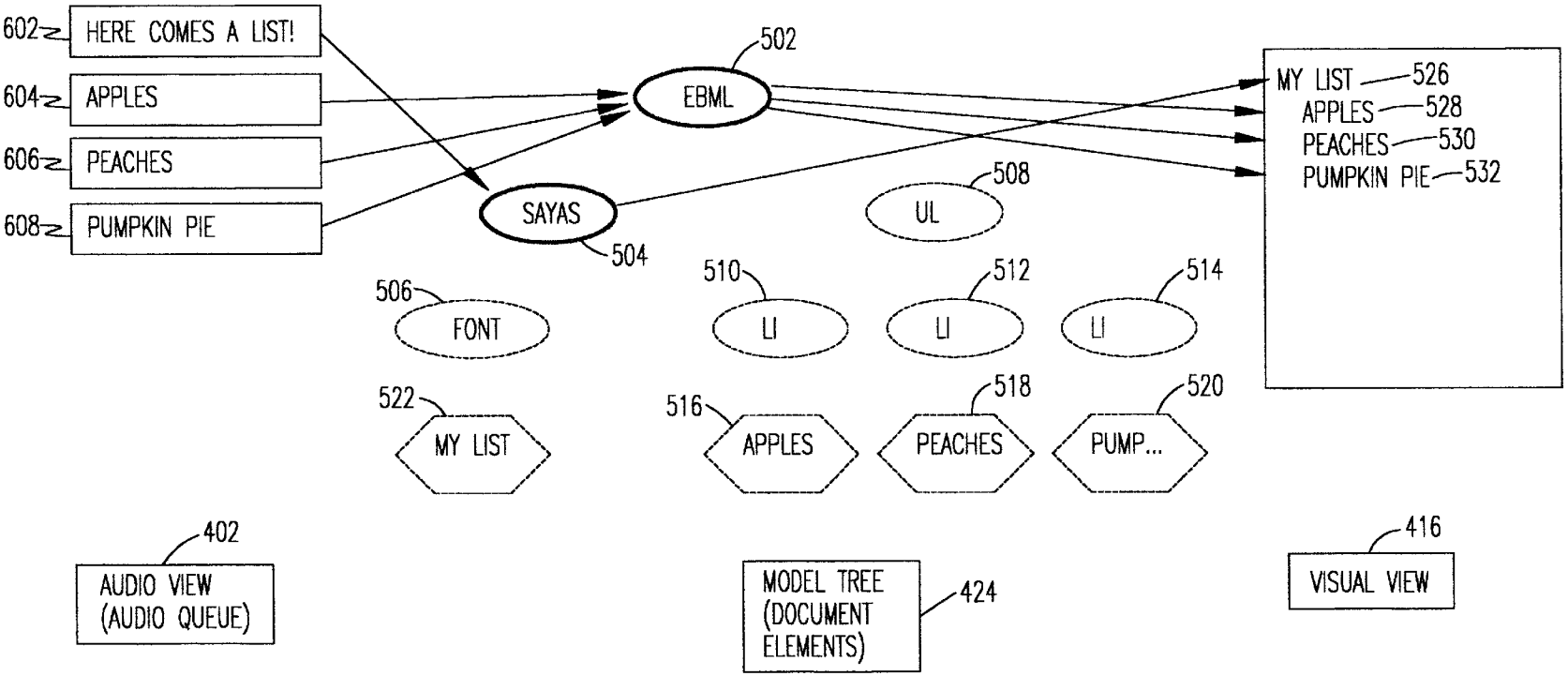
FIG. 7 shows an example of an adjusted view/model interrelationship after unnecessary nodes have been discarded.

FIG. 7 shows the tree with the references dissolved. The nodes available to be garbage collected are shown with dashed lines (506, 508, 510, 512, 514, 516, 518, 520 and 522).

While the invention has been described in terms of a single preferred embodiment, those skilled in the art will recognize that the invention can be practiced with modification within the spirit and scope of the appended claims.

Having thus described our invention, what we claim new and desire to secure by Letters Patent is as follows:

1. A process for rendering a document containing first, second and third text, first and second HTML tags and first and second types of non-HTML tags, said process comprising the steps of:

reading said document to determine that said first text is associated with said first HTML tag and the first type of non-HTML tag, said first type of non-HTML tag indicating that said first text should be rendered visually but not audibly, and in response to said first type of non-HTML tag, rendering said first text visually but not audibly, and in response to said first HTML tag, said first text is rendered visually in accordance with said first HTML tag;

reading said document to determine that said second text is associated with the second type of non-HTML tag, said second type of non-HTML tag indicating that said second text should be rendered audibly but not visually, and in response, rendering said second text audibly but not visually; and reading said document to determine that said third text is associated with said second HTML tag but is not associated with either said first type of non-HTML tag or said second type of non-HTML tag, and in response, rendering said third text both visually and audibly, and in response to said second type of HTML tag, said third text is rendered visually in accordance with said second HTML tag.

2. A process as set forth in claim 1 wherein said third text is associated only with HTML tags such that an HTML web browser would render said third text visually but not audibly.

3. A process as set forth in claim 1 wherein by default the absence of said first and second types of non-HTML tags in association with said third text indicates that said third text should be rendered both visually and audibly.

4. A process as set forth in claim 1 wherein said first type of non-HTML tag comprises a starting tag portion and an ending tag portion which enclose said first text and said first HTML tag associated with said first text such that said first text is rendered visually but not audibly.

5. A process as set forth in claim 1 wherein said second type of non-HTML tag comprises a starting tag portion and an ending tag portion which enclose said second text such that said second text is rendered audibly but not visually.

6. A process as set forth in claim 1 wherein said second text is rendered audibly literally corresponding to said second text, and said third text is rendered audibly literally corresponding to said third text.

7. A process as set forth in claim 1 wherein said third text is rendered audibly and visually synchronously, and as each word of said third text is rendered audibly, said each word is highlighted visually.

8. A process as set forth in claim 1 further comprising the step of parsing said document to separate text to be rendered audibly from text to be rendered visually, before the steps of rendering said first, second and third text.

9. A process as set forth in claim 1 wherein the steps of reading said document are performed by a browser.

10. A system for rendering a document containing first, second and third text, first and second HTML tags and first and second types of non-HTML tags, said system comprising:

means for reading said document to determine that said first text is associated with said first HTML tag and the first type of non-HTML tag, said first type of non-HTML tag indicating that said first text should be rendered visually but not audibly, and in response to said first type of non-HTML tag, rendering said first text visually but not audibly, and in response to said first HTML tag, said first text is rendered visually in accordance with said first HTML tag;

means for reading said document to determine that said second text is associated with the second type of non-HTML tag, said second type of non-HTML tag indicating that said second text should be rendered audibly but not visually, and in response, rendering said second text audibly but not visually; and means for reading said document to determine that said third text is associated with said second HTML tag but is not associated with either said first type of non-HTML tag or said second type of non-HTML tag, and in response, rendering said third text both visually and audibly, and in response to said second type of HTML tag, said third text is rendered visually in accordance with said second HTML tag.

11. A computer program product for rendering a document containing first, second and third text, first and second HTML tags and first and second types of non-HTML tags, said computer program product comprising:

a computer readable medium;

first program instruction means for reading said document to determine that said first text is associated with said first HTML tag and the first type of non-HTML tag, said first type of non-HTML tag indicating that said first text should be rendered visually but not audibly, and in response to said first type of non-HTML tag, rendering said first text visually but not audibly, and in response to said first HTML tag, said first text is rendered visually in accordance with said first HTML tag;

second program instruction means for reading said document to determine that said second text is associated with the second type of non-HTML tag, said second type of non-HTML tag indicating that said second text should be rendered audibly but not visually, and in response, rendering said second text audibly but not visually; and third program instruction means for reading said document to determine that said third text is associated with said second HTML tag but is not associated with either said first type of non-HTML tag or said second type of non-HTML tag, and in response, rendering said third text both visually and audibly, and in response to said second type of HTML tag, said third text is rendered visually in accordance with said second HTML tag; and wherein said first, second and third program instruction means are recorded on said medium.

12. A process for rendering a document containing first, second and third text and first and second types of tags, said process comprising the steps of:

reading said document to determine that said first text is associated with the first type of tag, said first type of tag indicating that said first text should be rendered visually but not audibly, and in response, rendering said first text visually but not audibly;

reading said document to determine that said second text is associated with the second type of tag, said second type of tag indicating that said second text should be rendered audibly but not visually, and in response, rendering said second text audibly but not visually; and reading said document to determine that said third text should be rendered both visually and audibly, and in response, rendering said third text both visually and audibly.

13. A process as set forth in claim 12 wherein said third text as associated with HTML tags such that an HTML web browser would render said third text visually but not audibly.

14. A process as set forth in claim 12 wherein said third text is associated with HTML tags and is rendered visually and audibly in accordance with said HTML tags.

15. A process as set forth in claim 12 wherein said document also includes HTML tags associated with said first and third text, and said web browser renders said first and third text visually in accordance with said HTML tags.

16. A process as set forth in claim 15 wherein said first type of tag comprises a starting tag portion and an ending tag portion which enclose said first text and the HTML tags associated with said first text such that said first text is rendered visually but not audibly.

17. A process as set forth in claim 12 wherein said first tag is not an HTML tag and said second tag is not an HTML tag.

18. A process as set forth in claim 12 wherein said second text is rendered audibly literally corresponding to said second text, and said third text is rendered audibly literally corresponding to said third text.

19. A process as set forth in claim 12 wherein said first text is rendered audibly and visually synchronously, and as each word of said first text is rendered audibly, said each word is highlighted visually.

20. A process as set forth in claim 12 further comprising the step of parsing said document to separate text to be rendered audibly from text to be rendered visually, before the steps of rendering said first, second and third text.

21. A computer program product for rendering a document containing first, second and third text and first and second types of tags, said program product comprising:

a computer readable medium;

first program instructions for reading said document to determine that said first text is associated with the first type of tag, said first type of tag indicating that said first text should be rendered visually but not audibly, and in response, rendering said first text visually but not audibly;

second program instructions for reading said document to determine that said second text is associated with the second type of tag, said second type of tag indicating that said second text should be rendered audibly but not visually, and in response, rendering said second text audibly but not visually; and third program instructions for reading said document to determining that said third text should be rendered both visually and audibly, and in response, rendering said third text both visually and audibly; and wherein said first, second and third program instructions are recorded on said medium.

22. A system for rendering a document containing first, second and third text and first and second types of tags, said system comprising:

means for reading said document to determine that said first text is associated with the first type of tag, said first type of tag indicating that said first text should be rendered visually but not audibly, and in response, rendering said first text visually but not audibly;

means for reading said document to determine that said second text is associated with the second type of tag, said second type of tag indicating that said second text should be rendered audibly but not visually, and in response, rendering said second text audibly but not visually; and means for reading said document to determining that said third text should be rendered both visually and audibly, and in response, rendering said third text both visually and audibly.

* * * * *